US011685011B2

(12) United States Patent
Kuhlmann

(10) Patent No.: US 11,685,011 B2
(45) Date of Patent: Jun. 27, 2023

(54) ANGLE GRINDER

(71) Applicant: Hilti Aktiengesellschaft, Schaan (LI)

(72) Inventor: Kevin Kuhlmann, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 924 days.

(21) Appl. No.: 16/605,671

(22) PCT Filed: Apr. 11, 2018

(86) PCT No.: PCT/EP2018/059309
§ 371 (c)(1),
(2) Date: Oct. 16, 2019

(87) PCT Pub. No.: WO2018/192823
PCT Pub. Date: Oct. 25, 2018

(65) Prior Publication Data

US 2020/0122288 A1 Apr. 23, 2020

(30) Foreign Application Priority Data

Apr. 20, 2017 (EP) ..... 17167197

(51) Int. Cl.
*B24B 23/02* (2006.01)
*B24B 51/00* (2006.01)
*B24B 55/10* (2006.01)

(52) U.S. Cl.
CPC ..... *B24B 23/028* (2013.01); *B24B 51/00* (2013.01); *B24B 55/102* (2013.01)

(58) Field of Classification Search
CPC ..... B24B 27/063; B24B 27/08
See application file for complete search history.

(56) References Cited

U.S. PATENT DOCUMENTS 6,860,792 B2 3/2005 Krondorfer et al.
2011/0171887 A1 7/2011 Tanimoto et al.
(Continued)

FOREIGN PATENT DOCUMENTS

CN 102149515 A 8/2011
CN 105710714 A 6/2016
(Continued)

OTHER PUBLICATIONS

English Translation of Chinese Patent Application CN 108436694 (2018) (Year: 2018).*
(Continued)

*Primary Examiner* — Jason D Shanske
*Assistant Examiner* — Alexander J Caporale
(74) *Attorney, Agent, or Firm* — Davidson, Davidson & Kappel, LLC

(57) ABSTRACT

An angle grinder (200), which includes a gear neck (210) for connecting a dust hood (100, 100') equipped with a flange (90), the angle grinder (200) including a sensor unit (20), with the aid of which it is possible to detect which type of dust hood (100, 100') is connected to the angle grinder (200), the angle grinder (200) also including rotational direction control electronics (230), which are connected by signals to the sensor unit (20) in such a way that the rotational direction (GGD, GLD) of a cutting wheel (220) of the angle grinder (200) is predefined as a function of the dust hood type detected by the sensor unit (20).

14 Claims, 4 Drawing Sheets

(56) References Cited

U.S. PATENT DOCUMENTS

| | | | |
|---|---|---|---|
| 2016/0178432 | A1 | 6/2016 | Masakawa |
| 2018/0281146 | A1 | 10/2018 | Tomonaga et al. |

FOREIGN PATENT DOCUMENTS

| | | | | | |
|---|---|---|---|---|---|
| CN | 2018105076274 | A | * | 8/2018 | |
| EP | 3141342 | A2 | | 3/2017 | |
| JP | 2014133277 | A | | 7/2014 | |
| WO | WO0243920 | A1 | | 6/2002 | |
| WO | WO-2017051892 | A1 | * | 3/2017 | ..... C08G 63/605 |
| WO | WO2017051893 | A1 | | 3/2017 | |

OTHER PUBLICATIONS

International Search Report of PCT/EP2018/059309, dated Jul. 5, 2018.

* cited by examiner

ANGLE GRINDER

The present invention relates to an angle grinder, which includes a gear neck for connecting a dust hood equipped with a flange.

BACKGROUND

Angle grinders of this type are generally known from the prior art. To avoid dust propagation during cutting work, angle grinders are typically equipped with a dust hood via which abraded substrate material may be extracted from the hood body. Dust hoods are furthermore known, which include a rinsing connection, via which rinsing water may be guided into the dust hood for the purpose of dust removal. Both types of dust hoods protect the health of a user of the angle grinder.

SUMMARY OF THE INVENTION

It is an object of the present invention to provide an angle grinder, which is configured to avoid operating errors, in particular with respect to operation using a dust hood.

The present invention provides that the angle grinder includes a sensor unit, with the aid of which it is possible to detect the type of dust hood connected to the angle grinder, the angle grinder furthermore including rotational direction control electronics, which are connected by signals to the sensor unit in such a way that the rotational direction of a cutting wheel of the angle grinder is predefined as a function of the dust hood type detected by the sensor unit.

The present invention includes the finding that angle grinders according to the prior art may be operated in different operating modes, the latter also being dependent, in particular, on the type of cutting as well as the dust removal. In the case of so-called dry cutting without dust extraction, for example, a cutting wheel of the angle grinder is driven in a codirectional rotational direction. The same is true in the case of so-called wet cutting, in which the rinsing water is introduced into the dust hood via a rinsing connection. In the case of dry cutting including dust extraction, however, a counterdirectional rotational direction of the cutting wheel of the angle grinder is preferred.

Due to the sensor unit provided according to the present invention and the rotational direction control electronics connected to this sensor unit, a rotational direction of a cutting wheel may now be automatically preselected, namely as a function of the dust hood type detected by the sensor unit. Operating errors during the rotational direction preselection may be ruled out thereby, which greatly increases the safety as well as the health of a user of the angle grinder.

In one particularly preferred embodiment, it is possible with the aid of the sensor unit to detect whether the dust hood is connected to the angle grinder. The rotation control electronics are preferably also designed to prevent a rotation of the cutting wheel if no dust hood is connected to the angle grinder.

It has proven to be advantageous if the sensor unit is situated on a surface of the angle grinder, preferably near the gear neck. The sensor unit may be situated on a handle end face of the angle grinder. It should be generally noted that, depending on the specific space requirements on the angle grinder as well as depending on the technical feasibility, the position of the sensor unit on the angle grinder may be adapted accordingly.

It has proven to be advantageous if the sensor unit includes a hood contact, with the aid of which it is possible to detect whether the dust hood is connected to the angle grinder. The sensor unit may also preferably include a hood type contact, with the aid of which a preferably mechanical coding of the dust hood connected to the angle grinder may be read out.

The hood contact and/or the hood type contact may be provided in the form of a switch, a pushbutton, a magnetic contact or a light barrier. A combination of these components is also conceivable. A number of preferred embodiments are to be described in greater detail below.

The hood type contact may be provided, for example, in the form of an ON/OFF/ON slide switch, which is situated on a surface of the angle grinder. The slide switch may be configured and situated, for example, in such a way that an oblique plane formed on the dust hood actuates the slide switch. In this regard, an oblique plane of a hood may represent a mechanical coding, which is read out by the hood type contact, i.e. the slide switch in the present example.

Accordingly, different oblique planes are also to be provided on different hood types.

Alternatively or in addition to the described oblique plane, mechanical codings may be provided on the dust hood in the form of a projection, recess or the like. The slide switch may be situated, for example, in that it is pushed to the right upon connecting a dust hood including a suction nozzle, which has a first mechanical coding. It may also be provided that the slide switch is pushed to the left upon connecting a dust hood including a rinsing connection, which has a second coding, which is different from the first coding. Alternatively or additionally, it may be provided that the slide switch remains in the middle position if no dust hood is situated on the angle grinder, and a rotation of the cutting wheel is prevented entirely, effectuated by the rotational direction control electronics.

The present invention is also achieved by a system, which includes an angle grinder described above and two dust hoods of different types, the type being defined in each case by a preferably mechanical coding, which may be read out by the sensor unit of the angle grinder.

The present invention is also achieved by a dust hood, which has a preferably mechanical coding on its surface, which may be read out by a sensor unit of an angle grinder.

Preferred embodiments of the angle grinder are to be described below. In all described exemplary embodiments, it is preferably provided that a codirectional rotational direction of the cutting wheel is predefined if the sensor unit detects a dust hood including a rinsing connection and/or a counterdirectional rotational direction is predefined for the cutting wheel if the sensor unit detects a dust hood including a suction nozzle.

The hood contact and the hood type contact may be functionally integrated, for example by providing an ON/OFF/ON toggle switch, which is preferably to be actuated by an elevation on a dust hood. For example, it may be provided that a dust hood including a rinsing connection actuates the toggle switch into a first ON position, whereby an electrical signal is supplied to the rotational direction control electronics, which results in a codirectional rotational direction of the cutting wheel if the angle grinder is activated.

The toggle switch may be placed into the second ON position by attaching a dust hood including a suction nozzle. Accordingly, a counterdirectional rotational direction of the cutting wheel is effectuated. If the toggle switch is in the OFF position (middle position), a rotation of the cutting wheel is preferably prevented entirely, since no dust hood is connected to the angle grinder. It is clear from this example, in particular, that one and the same switching element, i.e. the toggle switch in the present case, may form both the hood contact and the hood type contact.

Instead of the ON/OFF/ON toggle switch described above, an ON/ON toggle switch may also be provided. It is preferably actuated with the aid of an oblique plane on the hood. In this exemplary embodiment, the toggle switch forms a hood type contact exclusively, via which a counterdirectional rotational direction and a codirectional rotational direction may be predefined.

In another preferred embodiment, the sensor unit may include two pushbuttons, which together implement the hood contact and the hood type contact. The pushbuttons are preferably situated in such a way that a first mechanical coding on the dust hood including a rinsing connection actuates the first pushbutton and does not actuate the second pushbutton. A dust hood including a suction nozzle, on the other hand, has a second coding which is different from the first coding, which actuates the second pushbutton and leaves the first pushbutton unactuated. If neither a dust hood including a suction nozzle nor a suction dust hood including a rinsing connection is connected to the angle grinder, both pushbuttons preferably remain unactuated. In this case, a rotation of the cutting wheel is prevented by the rotational direction control electronics once the angle grinder has been activated.

In another preferred embodiment, the sensor unit of the angle grinder includes only a hood type contact, which is preferably provided in the form of a pushbutton. The rotational direction control electronics are configured to predefine a codirectional rotational direction when the pushbutton is pressed and to predefine a counterdirectional rotational direction when the pushbutton is not pressed.

In another preferred embodiment, the hood contact and/or the hood type contact may be provided by one or multiple light barriers. It is preferably provided that a mechanical coding of the dust hood including a rinsing connection effectuates an interruption of the first light barrier, and a mechanical coding on the dust hood including a suction nozzle effectuates an interruption of the second light barrier. In this regard, the first and second light barriers implement a hood type contact. If neither of the two light barriers is interrupted, this means that no dust hood or a third-party dust hood is connected to the angle grinder. The first and second light barriers thus also implement a hood contact, which causes a rotation of the cutting wheel to be prevented if neither of the two light barriers is interrupted.

In another embodiment, exactly one light barrier may be provided, which acts only as a hood type contact. It may be provided that a dust hood including a rinsing connection interrupts this light barrier, while a dust hood including a suction connection does not interrupt the light barrier.

In another preferred embodiment, the hood contact and/or the hood type contact may be implemented by one or multiple magnetic switches, which are provided by magnets on the hood. In this regard, the magnetic switches define the sensor unit, and the magnet(s) on the hood define(s) a mechanical coding. It is preferably provided that a dust hood including a suction nozzle has a first magnetic coding, which actuates a first magnetic switch, for example a reed contact. It may furthermore be provided that a dust hood including a rinsing connection has a second coding, which is different from the first magnetic coding and which is situated in such a way that the second magnetic switch on the angle grinder is activated. If no dust hood is provided on the angle grinder, the rotational direction control electronics effectuate a suppression of the rotation of the cutting wheel.

The switching functions of the individual contacts explained within the scope of the exemplary embodiments may, of course, also be logically inverted.

According to one independently patentable aspect, an angle grinder is provided, which includes a gear neck for connecting a dust hood equipped with a flange. The angle grinder includes a sensor unit, with the aid of which it is possible to detect whether a dust hood is connected to the angle grinder, the angle grinder also including rotational direction control electronics, which are connected by signals to the sensor unit in such a way that a rotation of the cutting wheel is prevented if no dust hood is connected to the angle grinder.

The present invention is also achieved by a method for operating an angle grinder, which includes a gear neck for connecting a dust hood equipped with a flange, the method including the following steps:

Detecting which type of dust hood is connected to the angle grinder with the aid of a sensor unit encompassed by the angle grinder;

Controlling a rotational direction of the cutting wheel of the angle grinder as a function of the state detected by the sensor unit.

The step of detecting preferably includes a reading out of a mechanical coding of the dust hood connected to the angle grinder.

The angle grinder is preferably a handheld power tool. The angle grinder is particularly preferably battery-operated, i.e. in particular without a power cord.

Other advantages result from the following description of the figures. The figures illustrate different exemplary embodiments of the present invention. The figures, the description and the claims contain numerous features in combination. Those skilled in the art will advantageously also consider the features individually and combine them to form other reasonable combinations.

BRIEF DESCRIPTION OF THE DRAWINGS

In the figures, identical and equivalent components are provided with identical reference numerals.

DETAILED DESCRIPTION

Figure 1:
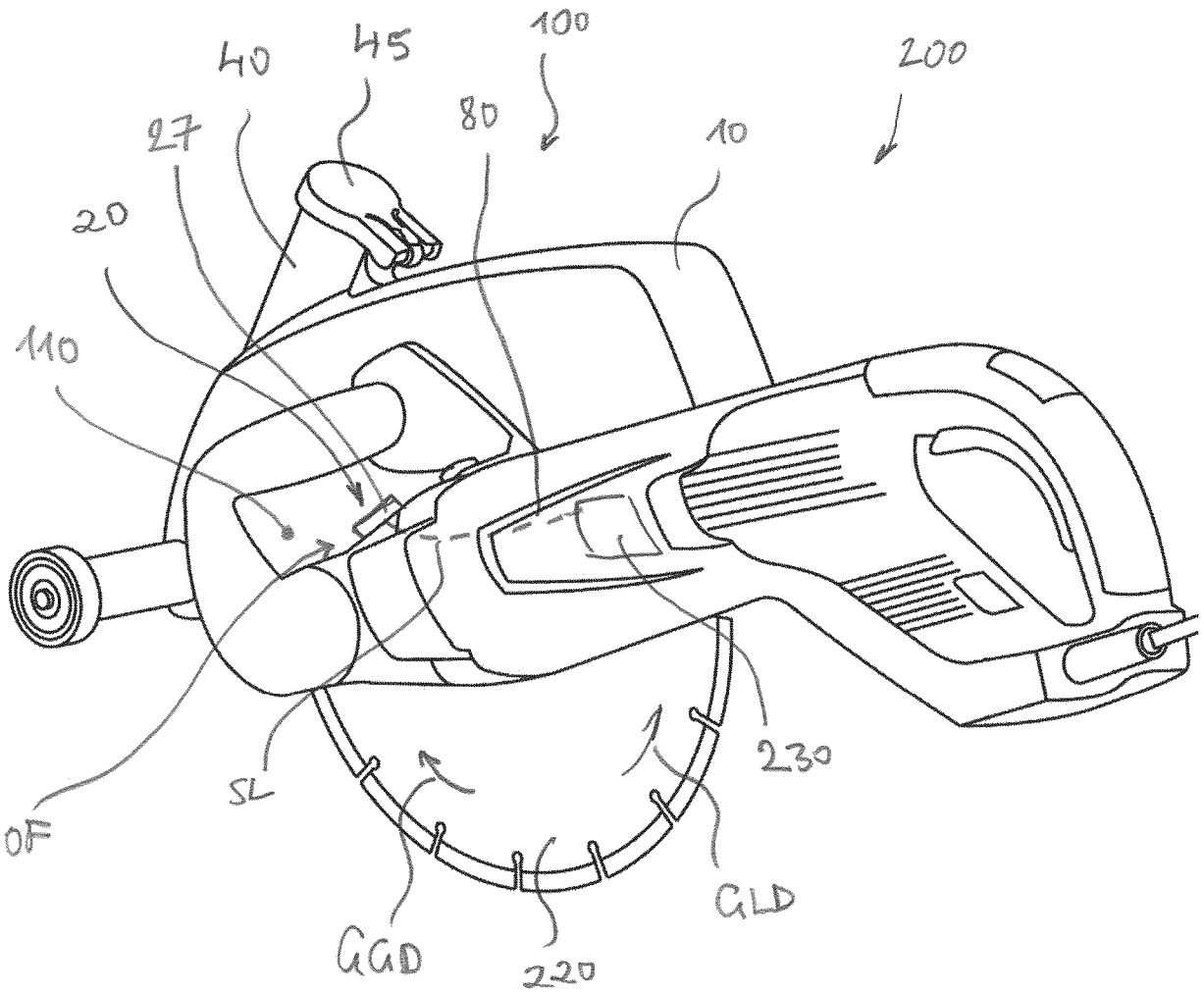
FIG. 1 shows one preferred exemplary embodiment of an angle grinder according to the present invention.

One preferred exemplary embodiment of an angle grinder 200 according to the present invention is illustrated in FIG. 1. A first dust hood 100 is connected to angle grinder 200 for the purpose of covering a circular cutting wheel 220 on both sides, at least in sections. First dust hood 100 includes a suction nozzle or connection 40, via which abraded substrate material may be extracted from hood body 10. Suction nozzle 40 includes a flap 45. A suction hose to be inserted into suction nozzle 40 is not illustrated in FIG. 1.

Angle grinder 200 includes a sensor unit 20, which is situated on a surface OF of angle grinder 200. Angle grinder 200 also includes rotational direction control electronics 230, which are connected by signals to sensor unit 20 via signal line 80. Rotational direction control electronics 230 are configured to predefine the rotational direction of cutting wheel 220 as a function of sensor signal SL originating from sensor unit 20.

Sensor unit 20 includes a hood type contact 27 in the form of a pushbutton, with the aid of which a first mechanical coding 110 of first dust hood 100 may be read out. In the exemplary embodiment illustrated in FIG. 1, first mechanical coding 110 is implemented by an oblique plane, which is formed on hood body 10 of first dust hood 100.

Rotational direction control electronics 230 are configured to effectuate a counterdirectional rotational direction GGD of the cutting wheel when the pushbutton (hood type contact 27) is actuated. This corresponds to a dry cutting operation including dust extraction.

However, if a second dust hood 100' including a rinsing connection (cf. FIG. 2: second dust hood 100'), for example, were to be connected to the angle grinder instead of first dust hood 100 including a suction nozzle 40, a codirectional rotational direction GLD would be predefined by rotational direction control electronics 230, which would mean a wet cutting operation without dust extraction.

Figure 2:
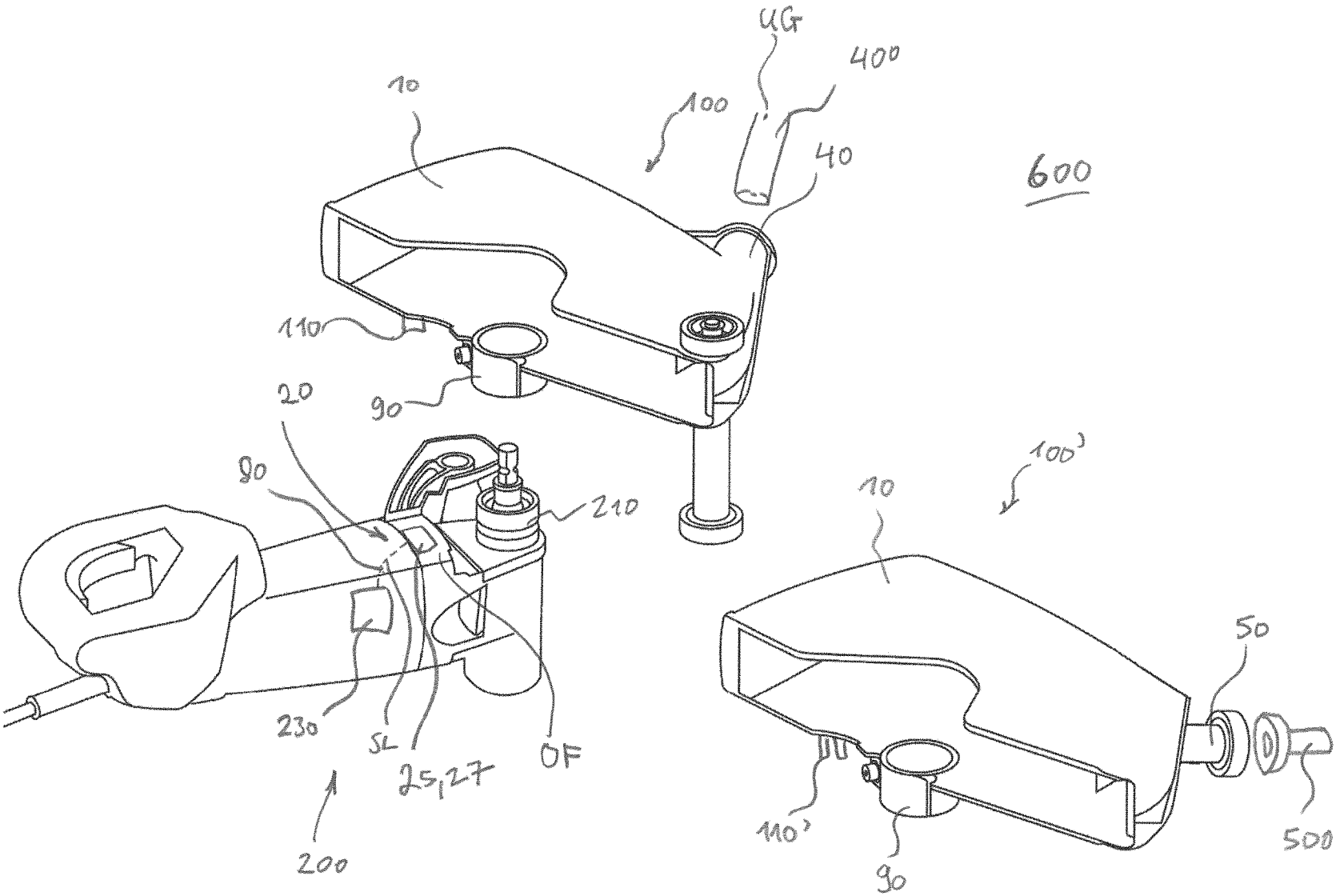
FIG. 2 shows one preferred exemplary embodiment of a system, which includes an angle grinder and two dust hoods of different types.

FIG. 2 shows a system 600, which includes an angle grinder 200 and two dust hoods 100, 100' of different types. A first dust hood 100 including a suction nozzle 40 is apparent in the upper area of FIG. 2. A suction hose 400 is insertable into suction nozzle 40, via which abraded substrate material UG may be extracted from first dust hood 100. A first mechanical coding 110 in the form of a single elevation is formed on hood body 10 of first dust hood 100.

Another dust hood type is illustrated at the lower right-hand side in FIG. 2, namely a second dust hood 100' including a rinsing connection 50. A rinsing hose 500 is connectable to rinsing connection 50. Second dust hood 100' includes a second mechanical coding 110' in the form of a double elevation.

On the left-hand side of FIG. 2, angle grinder 200 is illustrated including a gear neck 210, to which first dust hood 100 including suction nozzle 40 and second dust hood 100' including rinsing connection 50 are each connectable via their flange 90.

In the present exemplary embodiment, the angle grinder includes a sensor unit 20, which has a hood contact 25 and a hood type contact 27. For example, hood contact 25 and hood type contact 27 are supposed to be present in a functionally integrated manner in the form of an ON/OFF/ON toggle switch.

Angle grinder 200 includes rotational direction control electronics 230, which are connected to sensor unit 20 via a signal line 80. Rotational direction control electronics 230 are configured to predefine the rotational direction of cutting wheel 220 (cf. FIG. 1) as a function of the dust hood type detected by sensor unit 20.

Rotational direction control electronics 230 are also configured to prevent a rotation of the cutting wheel (cf. FIG. 1) if-as illustrated in FIG. 2-neither of first and second dust hoods 100, 100' is connected to angle grinder 200.

Sensor unit 20, which includes the aforementioned ON/OFF/ON toggle switch, is pushed into a first ON position upon connecting second dust hood 100' including rinsing connection 50, and is pressed into the second ON position upon connecting first dust hood 100 including suction nozzle 40. If neither of the two dust hoods 100, 100' is connected to angle grinder 200, the toggle switch, which is not illustrated in greater detail here, is in the middle position, which prevents a rotation of cutting wheel 220 upon activating angle grinder 200. This is effectuated by correspondingly configured rotational direction control electronics 230.

Figure 3:
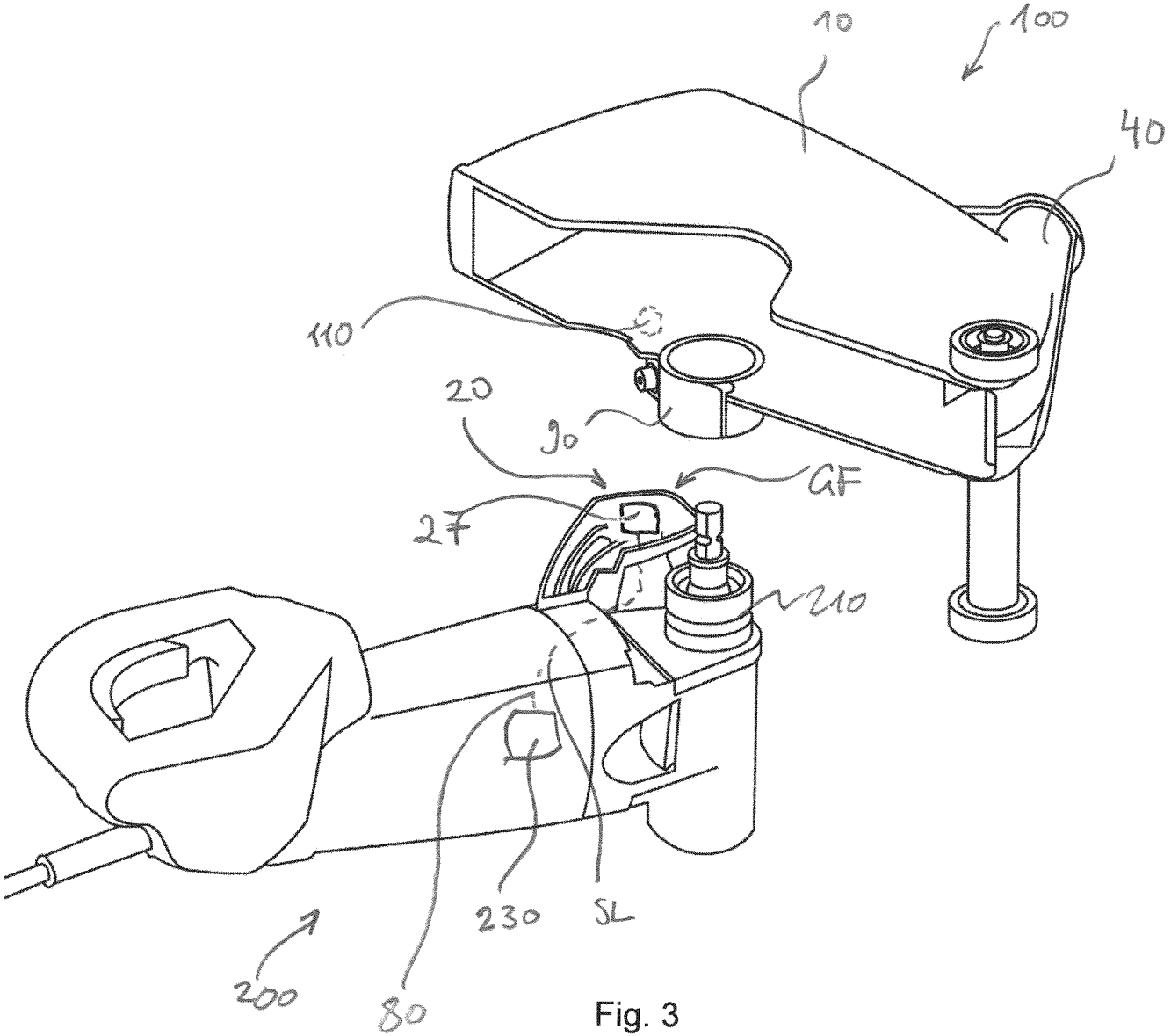
FIG. 3 shows another exemplary embodiment of an angle grinder according to the present invention.

FIG. 3 shows another preferred exemplary embodiment of an angle grinder 200 according to the present invention. Angle grinder 200 includes a sensor unit 20 on a handle end face GF, which, in the presently illustrated exemplary embodiment, has only one hood type contact 27 in the form of a magnetic contact.

First dust hood 100 including suction nozzle 40, which is shown above angle grinder 200, includes a magnet introduced into the first hood body 100 as first mechanical coding 110.

If first dust hood 100 is connected to angle grinder 200, hood type contact 27 in the form of a magnetic switch is actuated, e.g. electrically closed, by first mechanical coding 110 in the form of a magnet. The electrical closing of the magnetic switch is evaluated by rotational direction control electronics 230 in the form of a sensor signal.

In the present exemplary embodiment, rotational direction control electronics 230 are configured to drive cutting wheel 220 (cf. FIG. 1) in counter directional rotational direction GGD when first dust hood 100 is attached, i.e. when the magnetic contact is closed.

Figure 4:
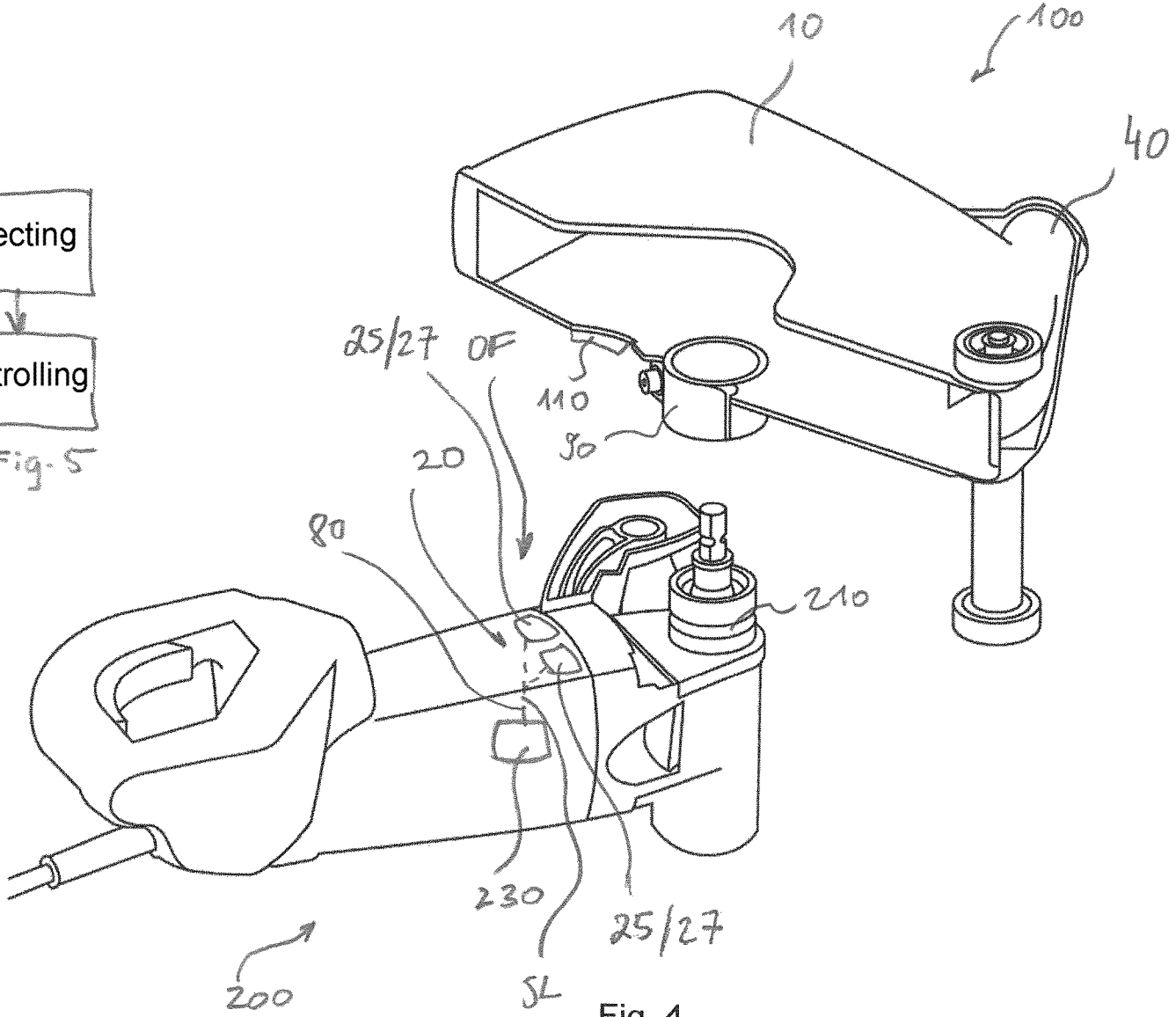
FIG. 4 shows another preferred exemplary embodiment of an angle grinder according to the present invention.

Finally, FIG. 4 shows another preferred exemplary embodiment of an angle grinder 200 according to the present invention. It includes a sensor unit 20 on its surface OF, which, in the presently illustrated exemplary embodiment, is provided by a hood contact 25 and a hood type contact 27, each in the form of a discreet pushbutton.

Hood contact 25 and hood type contact 27 operate in a functionally integrated manner, which is to be explained in greater detail below. First mechanical coding 110 on first dust hood 100 including suction nozzle 40 is configured to actuate the lower of the two pushbuttons. The connection of a dust hood including a rinsing connection, which is not illustrated here, would, in contrast, actuate the upper of the two pushbuttons. In this regard, the two pushbuttons together act as hood type contact 27, the rotational direction of the cutting wheel being predefined on the basis of its switching state.

At the same time, it is provided that, if both pushbuttons remain unactuated, i.e. if no first dust hood 100 is connected to angle grinder 200 as illustrated in FIG. 4, angle grinder 200 remains idle upon activation. In this regard, the pushbuttons, which are not illustrated in greater detail here, also act synergistically as a hood contact 25, with the aid of which it is possible to detect whether a first dust hood 100 is connected to the angle grinder.

Figure 5:
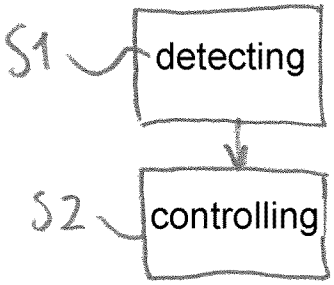
FIG. 5 shows a method according to the present invention for operating an angle grinder.

Finally, FIG. 5 shows a method according to the present invention for operating an angle grinder, for example angle grinder 200 described with reference to the preceding figures. In a first step S1, a detecting of which type of dust hood is connected to the angle grinder takes place with the aid of a sensor unit encompassed by the angle grinder. In a second step S2, a controlling of a rotational direction of the cutting wheel of the angle grinder takes place as a function of the state detected by the sensor unit.

LIST OF REFERENCE NUMERALS

10 hood body
20 sensor unit
25 hood contact

27 hood type contact
40 suction nozzle
45 flap
50 rinsing connection
80 signal line
90 flange
100 first dust hood
100' second dust hood
110 first mechanical coding
110' second mechanical coding
200 angle grinder
210 gear neck
220 cutting wheel
230 rotational direction control electronics
400 suction hose
500 rinsing hose
600 system
GF handle end face
GGD counter directional rotational direction
GLD codirectional rotational direction
OF surface
SL sensor signal
S1, S2 method steps
UG abraded substrate material

What is claimed is:

1. An angle grinder comprising:

a gear neck for connecting a dust hood, wherein the dust hood is equipped with a flange;

a sensor unit, wherein the sensor unit detects which type of dust hood is connected to the angle grinder, and rotational direction control electronics connected by signals to the sensor unit in such a way that a rotational direction of a cutting wheel of the angle grinder is predefined as a function of the dust hood type detected by the sensor unit.

2. The angle grinder as recited in claim 1 wherein the sensor unit also detects whether the dust hood is connected to the angle grinder, the rotational direction control electronics also being configured to prevent a rotation of the cutting wheel if no dust hood is connected to the angle grinder.

3. The angle grinder as recited in claim 1 wherein the sensor unit is situated on a surface of the angle grinder.

4. The angle grinder as recited in claim 1 wherein the sensor unit is situated on a surface of the angle grinder at the gear neck.

5. The angle grinder as recited in claim 1 wherein the sensor unit is situated on a handle end face of the angle grinder.

6. The angle grinder as recited in claim 1 wherein the sensor unit has a hood contact aiding detection of whether the dust hood is connected to the angle grinder.

7. The angle grinder as recited in claim 1 wherein the sensor unit has a hood contact aiding reading out of a coding of the dust hood connected to the angle grinder.

8. The angle grinder as recited in claim 7 wherein the coding is a mechanical coding.

9. The angle grinder as recited in claim 6 wherein the hood contact is in a form of a switch, a pushbutton, a magnetic contact or a light barrier.

10. The angle grinder as recited in claim 7 wherein the hood contact is in a form of a switch, a pushbutton, a magnetic contact or a light barrier.

11. A system comprising:

the angle grinder as recited in claim 1, and two dust hoods of different types, the type being defined by a coding readable by the sensor unit of the angle grinder.

12. The system as recited in claim 11 wherein the coding is a mechanical coding.

13. A method for operating an angle grinder including a gear neck for connecting a dust hood, wherein the dust hood is equipped with a flange, the method including the steps of:

detecting which type of dust hood is connected to the angle grinder by a sensor unit encompassed by the angle grinder; and controlling a rotational direction of a cutting wheel of the angle grinder as a function of the type of dust hood detected by the sensor unit.

14. The method as recited in claim 13 wherein the detecting step includes a reading out of a mechanical coding of the dust hood connected to the angle grinder.

* * * * *